US008215576B2

(12) United States Patent
Martinez, Jr. et al.

(10) Patent No.: US 8,215,576 B2
(45) Date of Patent: Jul. 10, 2012

(54) CRUSHER DEVICE

(75) Inventors: Joseph P. Martinez, Jr., Waukesha, WI (US); Kurt O'Bryan, Sr., Waukesha, WI (US)

(73) Assignee: FLSMIDTH A/S (DK)

( * ) Notice: Subject to any disclaimer, the term of this patent is extended or adjusted under 35 U.S.C. 154(b) by 61 days.

(21) Appl. No.: 12/576,618

(22) Filed: Oct. 9, 2009

(65) Prior Publication Data

US 2011/0084156 A1 Apr. 14, 2011

(51) Int. Cl.
*B02C 15/10* (2006.01)
*B02C 17/08* (2006.01)

(52) U.S. Cl. ..... 241/208; 241/214; 241/245

(58) Field of Classification Search ..... 241/208, 241/209, 213–215; 29/897.2, 401.1, 525.01
See application file for complete search history.

(56) References Cited

U.S. PATENT DOCUMENTS

| | | | | | |
|---|---|---|---|---|---|
| 1,016,904 | A | * | 2/1912 | Stome | 241/208 |
| 1,050,398 | A | * | 1/1913 | Smith | 241/208 |
| 1,309,104 | A | * | 7/1919 | Sanborn | 241/208 |
| 1,537,564 | A | | 5/1925 | Symons | |
| 1,656,004 | A | * | 1/1928 | Kiene | 241/208 |
| 2,190,036 | A | * | 2/1940 | Morch | 241/156 |
| 2,231,491 | A | * | 2/1941 | Bousman | 241/208 |
| 2,500,908 | A | * | 3/1950 | Symons | 241/24.13 |
| 2,829,842 | A | * | 4/1958 | Messinger | 241/208 |
| 3,281,083 | A | * | 10/1966 | Johnson | 241/208 |
| 4,192,472 | A | | 3/1980 | Johnson | |
| 4,391,414 | A | | 7/1983 | Reiter | |
| 4,478,373 | A | | 10/1984 | Gieschen | |
| 4,756,484 | A | | 7/1988 | Bechler et al. | |
| 4,844,362 | A | | 7/1989 | Revnivtsev et al. | |
| 4,892,257 | A | * | 1/1990 | Stoeckmann et al. | 241/32 |
| 4,895,311 | A | | 1/1990 | Arakawa | |
| 5,312,053 | A | | 5/1994 | Ganser, IV | |
| 5,372,318 | A | | 12/1994 | Jacobson | |
| 5,413,756 | A | | 5/1995 | Sahu | |
| 5,730,258 | A | | 3/1998 | Evans | |
| 5,775,607 | A | * | 7/1998 | Bayliss et al. | 241/207 |
| 5,779,166 | A | | 7/1998 | Ruokonen et al. | |
| 5,810,269 | A | | 9/1998 | Shannon | |
| 5,996,916 | A | | 12/1999 | Musil | |
| 6,000,648 | A | | 12/1999 | Ambrose | |
| 6,036,129 | A | | 3/2000 | Ambrose | |
| 6,213,418 | B1 | | 4/2001 | Gabriel et al. | |
| 6,446,977 | B1 | | 9/2002 | Thiede | |
| 6,648,255 | B2 | * | 11/2003 | Martinez et al. | 241/209 |
| 7,048,214 | B2 | | 5/2006 | Johnson et al. | |
| 2003/0183706 | A1 | | 10/2003 | Cheng | |
| 2005/0269436 | A1 | | 12/2005 | Sawant et al. | |
| 2006/0144979 | A1 | | 7/2006 | Nieminen et al. | |
| 2008/0115978 | A1 | | 5/2008 | Hall et al. | |
| 2008/0272218 | A1 | | 11/2008 | Niklewski | |

* cited by examiner

*Primary Examiner* — Bena Miller
(74) *Attorney, Agent, or Firm* — Aaron M. Pile; Daniel DeJoseph; Jeffrey A. Sharp

(57) ABSTRACT

A gyratory crusher is provided that has a crusher head, an eccentric assembly connected to the crusher head, a bushing positioned between the eccentric assembly and the crusher head, a retaining member, and a plurality of fasteners. The retaining member has an opening and a plurality of holes. The retaining member is positioned adjacent to the eccentric assembly such that a portion of the eccentric assembly is within the opening. Each fastener extends through a respective hole to the crusher head. The retaining member is positioned adjacent to the crusher head and the eccentric assembly such that the retaining member is decoupled from the bushing. The cone crusher is preferably configured to crush rock, stone, ore or minerals. A method of making or retrofitting a crushing device such as, for example, a cone crusher or other gyratory crusher, is also provided.

18 Claims, 15 Drawing Sheets

CRUSHER DEVICE

FIELD OF INVENTION

The present invention relates to crushing devices and, more particularly, to cone crushers.

BACKGROUND OF THE INVENTION

Crushing devices, such as cone crushers, are typically used to crush rock, ore or minerals. Crushers may form a circuit of a process configured to crush material from a first size to a smaller size. After the material is crushed, the material may be moved to a grinding circuit for grinding the material to an even smaller size. Examples of crusher devices may be appreciated from U.S. Pat. Nos. 1,537,564, 4,192,472, 4,391,414, 4,478,373, 4,756,484, 4,844,362, 4,892,257, 4,895,311, 5,312,053, 5,372,318, 5,779,166, 5,810,269, 5,996,916, 6,000,648, 6,036,129, 6,213,418, 6,446,977, 6,648,255, 7,048,214 and U.S. Patent Application Publication Nos. 2003/0183706, 2005/0269436, 2006/0144979, 2008/0115978, and 2008/0272218.

A cone crusher typically breaks rock by squeezing the rock between an eccentrically gyrating spindle and an enclosing concave hopper. As rock enters the top of the cone crusher, it becomes wedged and squeezed between the mantle and the bowl liner or concave. Large pieces of ore or rock are broken and then fall to a lower position (because they are now smaller) where they are broken again. This process continues until the pieces are small enough to fall through a narrow opening at the bottom of the crusher.

The crusher head of cone crushers is typically guided by an eccentric assembly to actuate movement of the head for crushing material. A bushing is typically positioned between the crusher head and the eccentric assembly. A drive mechanism is often coupled to the eccentric assembly to drive movement of the eccentric assembly to move the crusher head to crush material. The bushing may include a flange that is integral to the bushing. The flange may have holes that permit bolts to pass through the holes to connect to the crusher head to ensure a very tight attachment between the bushing and the crusher head as may be appreciated from FIG. 13. The flanged bushing is typically composed of bronze.

Bushings are configured to provide a tight running fit between different components, such as the eccentric assembly and the crusher head. For instance, U.S. Pat. Nos. 5,413,756 and 5,730,258, both disclose bushings configured to provide a tight fit between different components to ensure the components are secured together, to provide a replaceable wear surface and to prevent other material from becoming positioned between the attached components.

Cone crushers often experience significant stress and strain as a result of crushing large rocks. Indeed, large variations in stress and strain experienced by the crusher head, shaft, and bushing of a cone crusher can be greatly increased when breaking up very large rocks. For instance, the crusher may be configured to crush rocks within a first size range. However, some rocks may enter the crusher that are much larger than this size range. The breaking of such relatively large rocks induces significant stress and strain on the crusher head, bushing and shaft. Significant additional stress and strain may also be introduced by attempting to crush an object that is not normally able to be crushed, such as a large steel ball or shovel tooth. The flange of the bushing can fail, or break, as a result of the stress and strain experienced by the shaft, bushing, and crusher head. The failure of the flange can also cause the bolts to become dislodged from the crusher. In some instances, the broken flange may become dislodge such that further operation of the crusher melts the flange or partially melts the flange, which can cause the crusher to seize. Such an occurrence can also cause other damage to the crusher and may result in significant down time that is needed for repairing the crusher.

A new crusher design is needed. Preferably, the new crusher design increases the stress and strain that a crusher may experience without experiencing a failure. The new design is also preferably configured to be easily implemented as an improvement on current designs of crusher devices to keep the cost of fabricating the new design of the crusher as low as possible.

SUMMARY OF THE INVENTION

A crusher is provided. One embodiment of the crusher may be a gyratory crusher. The gyratory crusher may include a crusher head, an eccentric assembly coupled to the crusher head, an actuation mechanism coupled to the eccentric assembly to move the eccentric assembly, a shaft configured to support the crusher head or the eccentric assembly, a bushing positioned between the eccentric assembly and the crusher head, a plurality of fasteners and a retaining member. The retaining member has an opening and a plurality of holes. The retaining member is positioned adjacent to the eccentric assembly such that a portion of the eccentric assembly is within the opening of the retaining member. Each fastener extends through a respective hole to the crusher head. The retaining member is positioned adjacent to the eccentric assembly such that the retaining member is decoupled from the bushing.

The crusher head is preferably sized and configured to crush material for cement manufacturing, mining operations, or for crushing material sufficiently for the material to be grinded.

The gyratory crusher may be configured so that a portion of the bushing is positioned above the retaining member. The bushing may be generally cylindrical in shape or may have a generally polygonal shape. The retaining member is preferably a ring composed of steel or stainless steel and the bushing is preferably composed of bronze. The retaining ring may alternatively be a retaining plate that is decoupled from the bushing. The retaining plate may be generally cylindrical, generally rectangular, or generally polygonal in shape.

It should be understood that the shaft is preferably cylindrical in shape. Of course, the shaft may be generally cylindrical, generally rectangular, or generally polygonal in shape as well.

The actuation mechanism is preferably configured to transfer power or kinetic energy from a drive mechanism to the eccentric assembly to move the eccentric assembly. Preferably, the drive mechanism transfers power or kinetic energy through a pinion to the eccentric assembly to rotate the eccentric assembly. The eccentric assembly is connected to the crusher head such that movement of the eccentric assembly causes the crusher head to move to crush material.

Preferably, the eccentric assembly includes an eccentric and an eccentric bushing. The eccentric bushing may be positioned between the shaft and the eccentric. The eccentric assembly may also include a gear attached between the eccentric and a pinion of the actuation mechanism.

In some embodiments of the gyratory crusher, each fastener has a first end and a second end opposite the first end. The first end of each fastener has a head and the second end has threads. The retaining member has a first surface and a second surface opposite the first surface. The first surface faces toward the crusher head. Each fastener extends through a respective hole in the retaining member such that a portion of the head engages or applies force to a portion of the second surface and the second end engages a portion of the crusher head. For example, each fastener may be a bolt or a screw that passes through a hole in the retaining member to the crusher head.

It should be understood that embodiments of the gyratory crusher may also include washers. Each washer may be positioned between the head of a respective fastener and the second surface of the retaining member. The washers may be, for instance, spring washers or flat washers.

A method of making a crusher sized and configured to crush at least one of rock, stone, minerals and ore is also provided. Preferably, the crusher is a gyrator crusher, such as a cone crusher. The method can include the steps of providing a crusher head, providing a shaft, providing a bushing, providing an eccentric assembly, providing an actuation mechanism, providing a retaining member, and providing a plurality of fasteners. The retaining member has an opening and a plurality of holes. The opening is sized and configured to receive a portion of the eccentric assembly. A portion of each fastener is sized and configured to pass through a respective hole of the retaining member. Embodiments of the method may include the steps of coupling the actuation mechanism to the eccentric assembly, positioning a bushing adjacent to the eccentric assembly and the crusher head, coupling the eccentric assembly to the crusher head, positioning the shaft to support the crusher head, positioning a portion of the eccentric assembly through the opening of the retaining member, positioning the fasteners through the holes of the retaining member, attaching the fasteners to the crusher head. The fasteners are attached to the crusher head and the eccentric is coupled to the crusher head such that the retaining member is decoupled from the bushing.

Embodiments of the method may also include attaching the bushing to the crusher head, and positioning the bushing between the eccentric assembly and the crusher head. The bushing may be positioned between the shaft and the retaining member such that a portion of the bushing is within the opening of the retaining member or above the retaining member.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of crushing devices, such as gyratory crushers, crushing circuits or cone crushers, and methods of making such devices are shown in the accompanying drawings in which.

DETAILED DESCRIPTION OF PRESENT PREFERRED EMBODIMENTS

Figure 1:
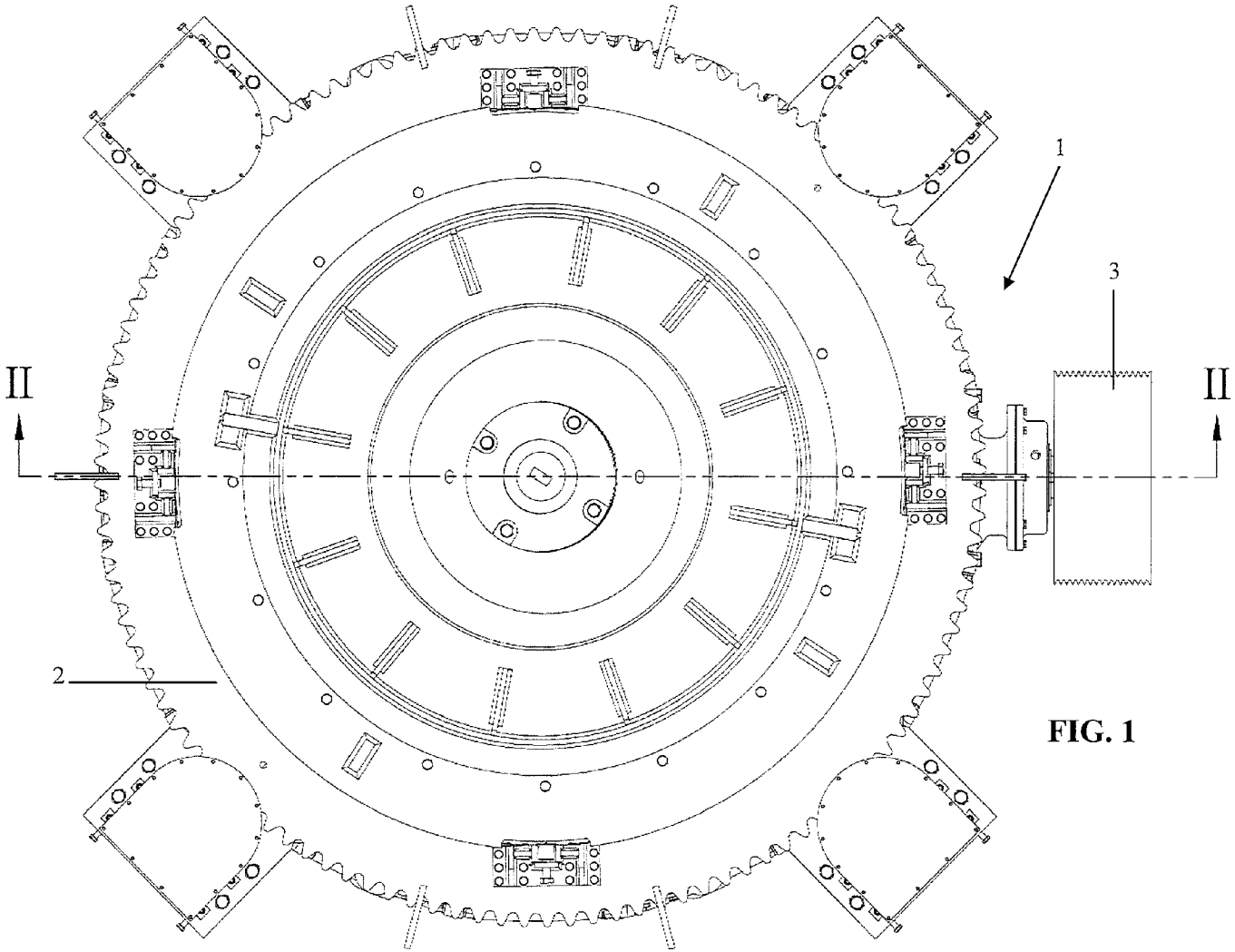
FIG. 1 is a top view of a first present preferred embodiment of a crusher device.
Figure 2:
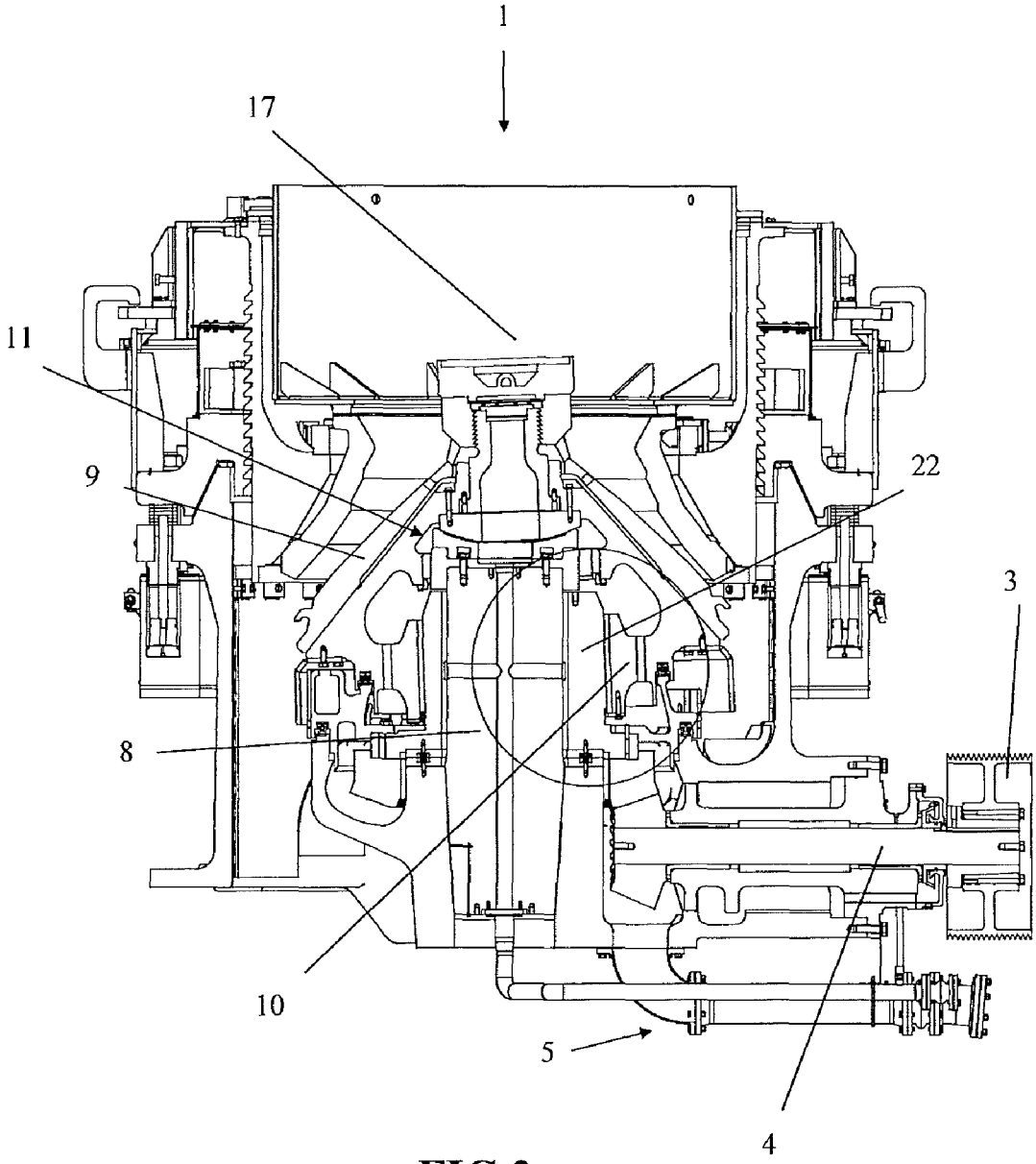
FIG. 2 is a cross sectional view of the first present preferred embodiment of the crusher device taken along line II-II in FIG. 1.
Figure 2A:
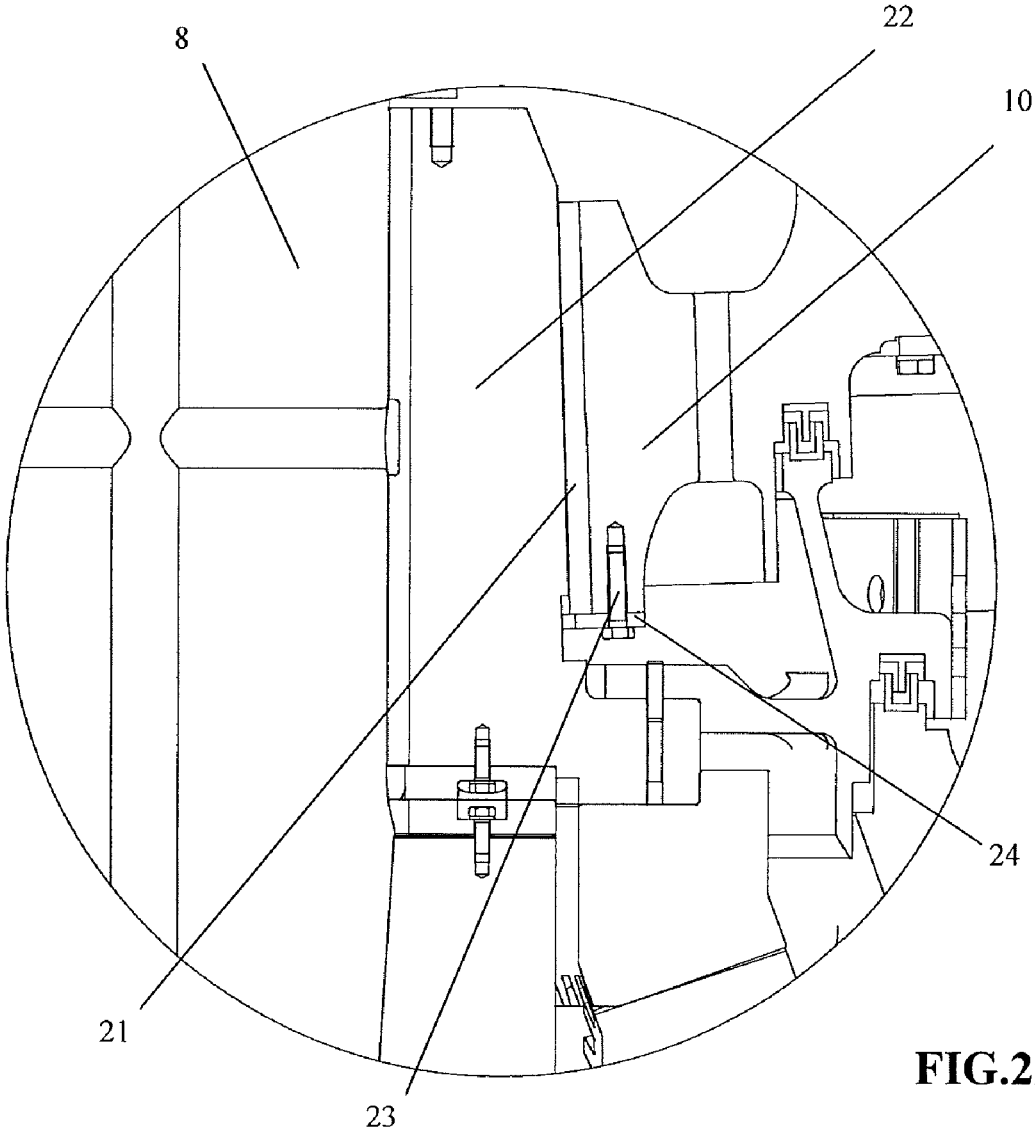
FIG. 2A is an enlarged cross sectional view taken along line II-II in FIG. 1 and is also circled in FIG. 2, illustrating the main shaft, bushing, retaining member, crusher head, and eccentric assembly portions of the first present preferred embodiment of the crusher device.
Figure 3:
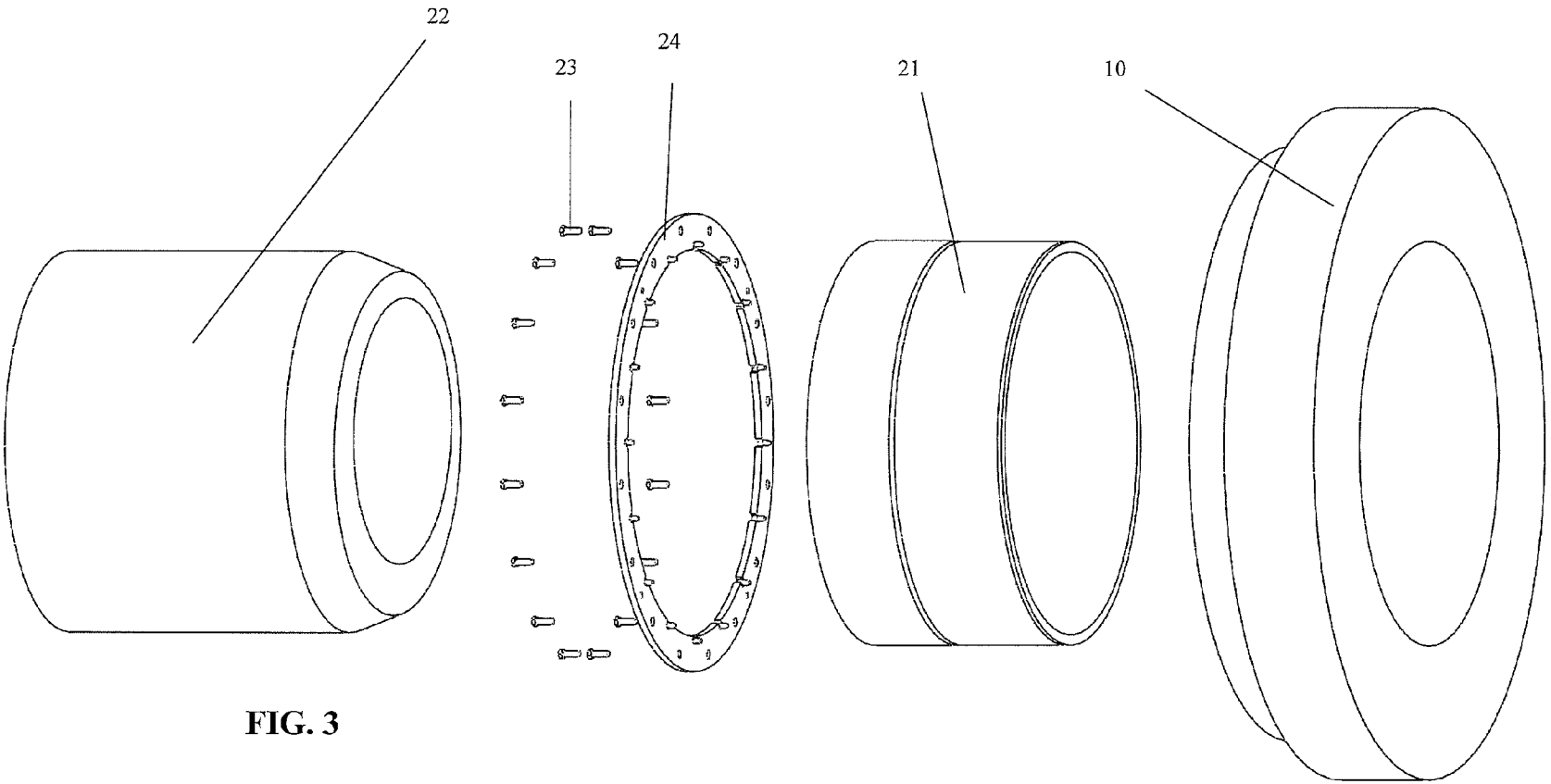
FIG. 3 is an exploded view of a present preferred arrangement that may be used in embodiments of the crusher device, which includes a present preferred retaining member and a present preferred bronze bushing positioned between a portion of a present preferred eccentric assembly and a portion of a present preferred crusher head.

A cone crusher 1 that includes a housing 2 is shown in FIGS. 1-3. The housing 2 encloses a hopper 17 that has an opening sized and configured to receive material for crushing, such as rock, ore, minerals or stone. The cone crusher 1 includes a piping system 5 that is configured to provide lubrication from a lubrication system to moveable components of the cone crusher, such as an eccentric assembly 22. The cone crusher 1 also includes a drive assembly 3 that is configured to rotate a countershaft 4. The countershaft 4 may be connected within a channel of the housing and engage bushings or bearings. The drive assembly 3 is configured to rotate the countershaft 4 to actuate movement of an eccentric assembly 22 to cause the crushing apparatus 11 of the cone crusher to move to crush material. Preferably, the drive assembly 3 is rotated by a belt (not shown). The belt may be driven by an electric motor, an engine or other powering device.

The countershaft 4 is connected to an eccentric assembly 22. Preferably, the eccentric assembly 22 is coupled to the countershaft 4 via intermeshing gears or a gear and pinion arrangement. Of course, other coupling mechanisms may also be used.

The eccentric assembly 22 is connected to the countershaft 4 such that the eccentric assembly 22 is actuated by movement of the countershaft 4 to move the crushing apparatus 11. Movement of the crushing apparatus 11 crushes material received from hopper 17 of the cone crusher 1.

The crushing apparatus 11 includes a crusher head 10 and mantle 9. The crushing apparatus 11 is connected to the eccentric assembly 22 so that movement of the eccentric assembly 22 causes the crushing apparatus 11 to move. Preferably, the eccentric assembly 22 is configured to rotate to cause the crusher head 10 to move.

The eccentric assembly 22 is positioned adjacent to the main shaft 8. The eccentric assembly 22 may include an eccentric bushing between an eccentric and the shaft 8. A bushing 21 is also positioned between the eccentric assembly 22 and the crusher head 10. The bushing 21 is positioned adjacent to the eccentric of the eccentric assembly with sufficient spacing to permit lubricant, such as oil, to flow between the eccentric and the bushing 21. The bushing 21 is preferably configured to provide support to the crusher head 10 and is preferably configured to help support the frictional and other forces that may act on the connection between the eccentric assembly 22 and the crusher head 10.

A retaining member 24 is positioned around a portion of the main shaft 8. The retaining member 24 is preferably a retaining ring that is nineteen millimeters thick or 0.75 inches thick and includes an opening sized to receive the main shaft 8 and the bushing 21. The retaining member 24 is also positioned adjacent to the eccentric assembly 22 of the crushing apparatus 11. Fasteners 23 pass through holes formed in the retaining member 24 and attach to the crusher head 10 of the crushing apparatus 11. The fasteners 23 are preferably bolts or screws that pass through the holes to attach the retaining member 24 to the crusher head 10. Preferably, the holes are equidistantly spaced from each other and are arranged to receive sixteen different bolts that are twenty-four millimeters in diameter.

It should be understood that the attachment of the retaining member 24 to the crusher head 10 decouples the retaining member 24 from the bushing 21. As a result, any force that may be exerted by the eccentric assembly 22 or crushing apparatus portion on the bushing 21 will be less likely to result in damage to any components.

Figure 13:
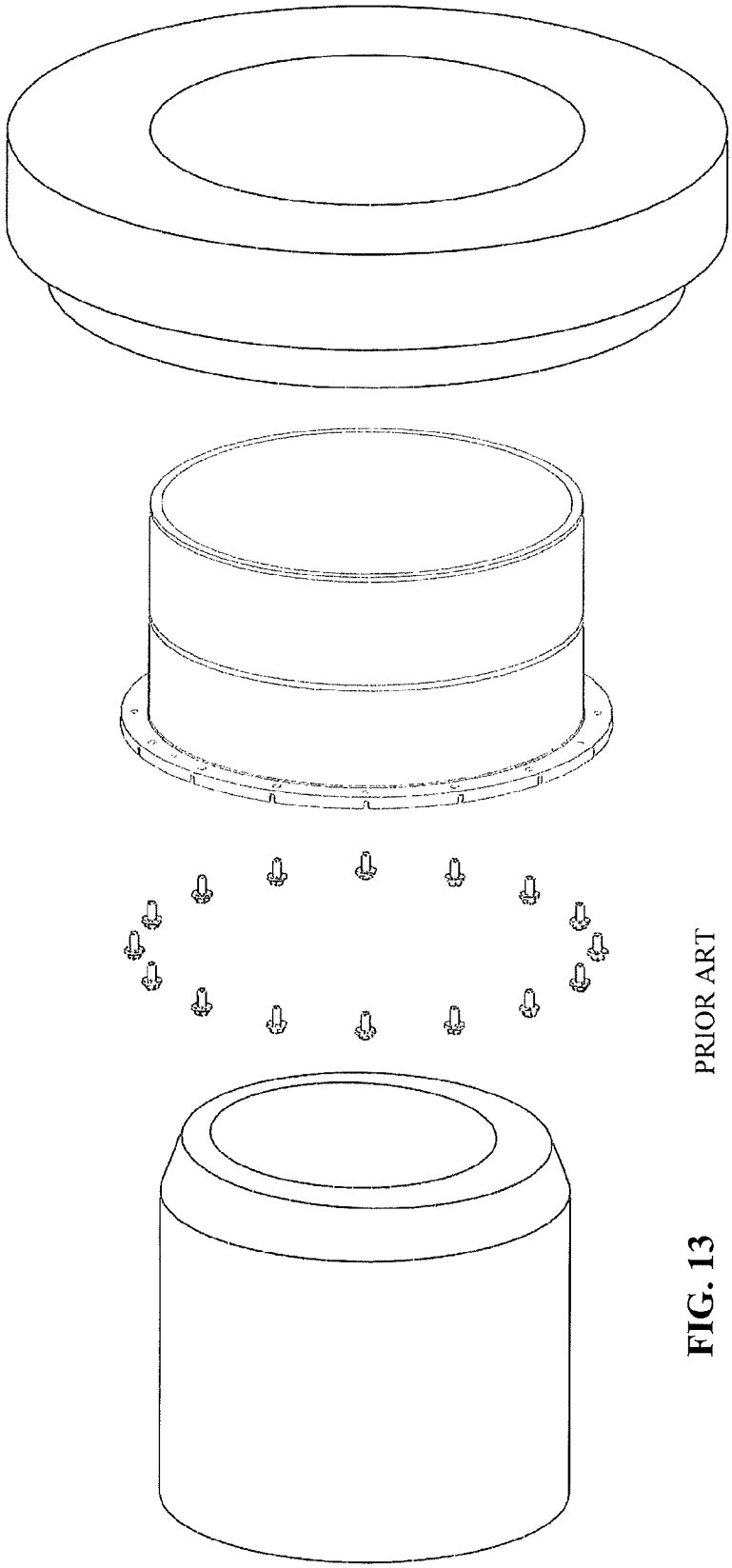
FIG. 13 PRIOR ART
FIG. 13 is an exploded view of a prior art cone crusher lower head bushing arrangement, which includes a bronze bushing that is attached to a portion of an eccentric and has an integral flange configured to receive bolts for attaching to a crusher head.

As may be appreciated from FIG. 13, prior art designs of cone crushers included a bronze bushing that had an integral circular flange that was ten millimeters thick at the bolted connections. The flange included holes sized to receive bolts that had a diameter of twenty millimeters. Such flanges often broke from the cylindrical portion of the bushing due to excessive force that the crushing apparatus 11 may have exerted on the flange while the cone crusher was used to crush material. For instance, the crusher head may exert significant force on an outer edge portion of the flange or on the flange bolts such that the bolts bend into the flange or transfer significant force to the flange. Such forces can weaken the flange or cause the flange to significantly deform or break. These relatively excessive forces are most often exerted on the flange when the crusher is crushing material that is fed into the crusher at a much larger size than the size range of material the crusher is designed to crush or when material that is not capable of being crushed by the crusher is fed into the crusher.

New bushing design options were contemplated to provide a crusher that could withstand significant forces so that the crusher could be utilized with less control over the size of the material being fed into the crusher or to provide a crusher that can crush significantly larger sized material without needing larger components. One contemplated obvious improvement to the prior art bushing design was to double the thickness of the bronze flange so that the flange was twenty millimeters thick instead of being ten millimeters thick at the bolted connections. A second contemplated obvious improvement was to make the bronze flange twenty millimeters thick and to also include holes in the flange for receiving bolts that had a twenty-four millimeter diameter so that the thicker flange would also use thicker bolts.

The first and second contemplated improvements were compared to an embodiment of the above discussed decoupled retaining member design that utilized a steel or stainless steel retaining ring that is nineteen millimeters thick, or 0.75 inches thick, and the prior art design to determine whether the decoupled retaining member design would provide any advantage to the prior art design or other contemplated improvements. The holes in the bronze flanges and retaining member included in the modeled designs were equally spaced to permit sixteen bolts to pass through the holes.

The comparison was done by modeling that was conducted using SolidWorks CAD software and Cosmos FEA software. The modeling applied traction and pressure loads to the internal diameter of the cylindrical bushing over a four inch by four inch area, or sixteen square inch area. The traction and pressure loads were applied to represent a contemplated case of bushing friction and pressure from crushing loads.

Figure 4:
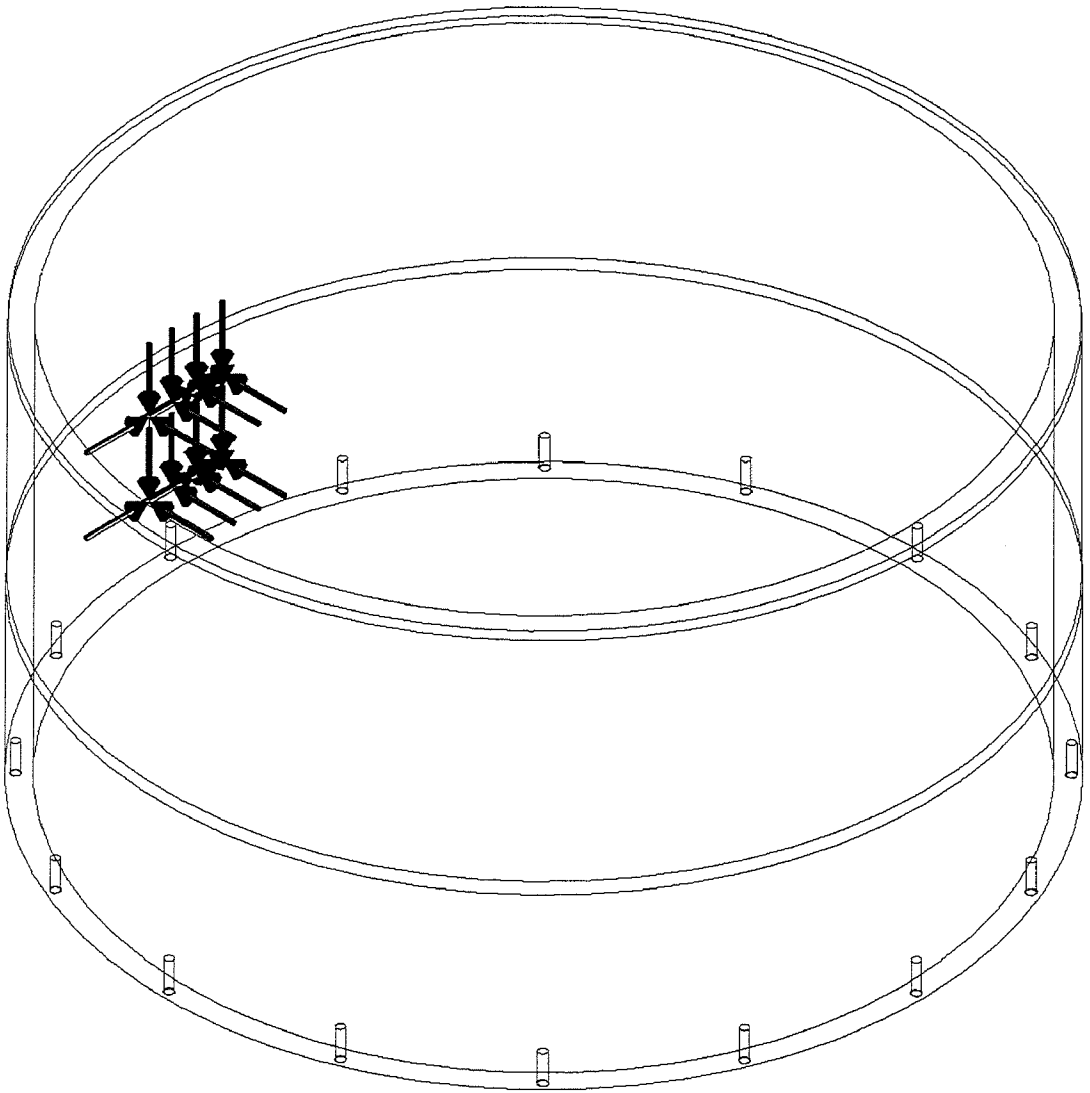
FIG. 4 is a fragmentary view of a model illustrating load vectors that act on a portion of a bushing positioned between a crusher head and an eccentric.

The conducted FEA study and analysis was comparative in nature. The absolute values of the loads, deformations and stresses are not necessarily of as much value as is the relative comparisons of values. In general terms, the load area experienced a large radial component along with a smaller tangential component (torque for integral flange bushing models) as well as a smaller axial component. In addition to the structural loads, the components are also subjected to varying degrees of constraint load due to thermal expansion. The load vectors acting on the bushing and flange arrangement of the first and second contemplated improvements and the retaining member improvement conducted in the modeling are indicated in FIG. 4.

Figure 5:
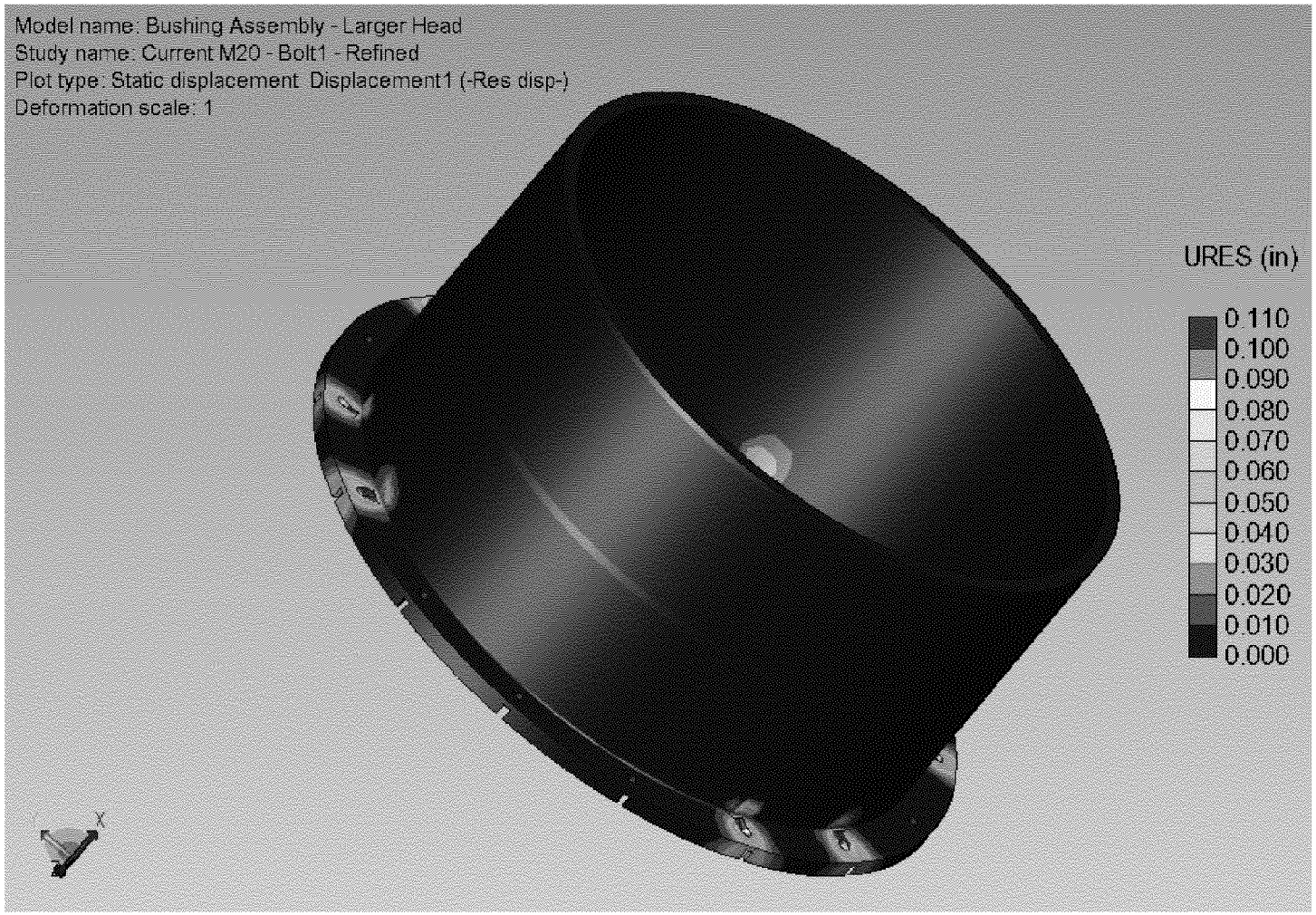
FIG. 5 illustrates modeled deformation results of a prior art bronze bushing design.
Figure 6:
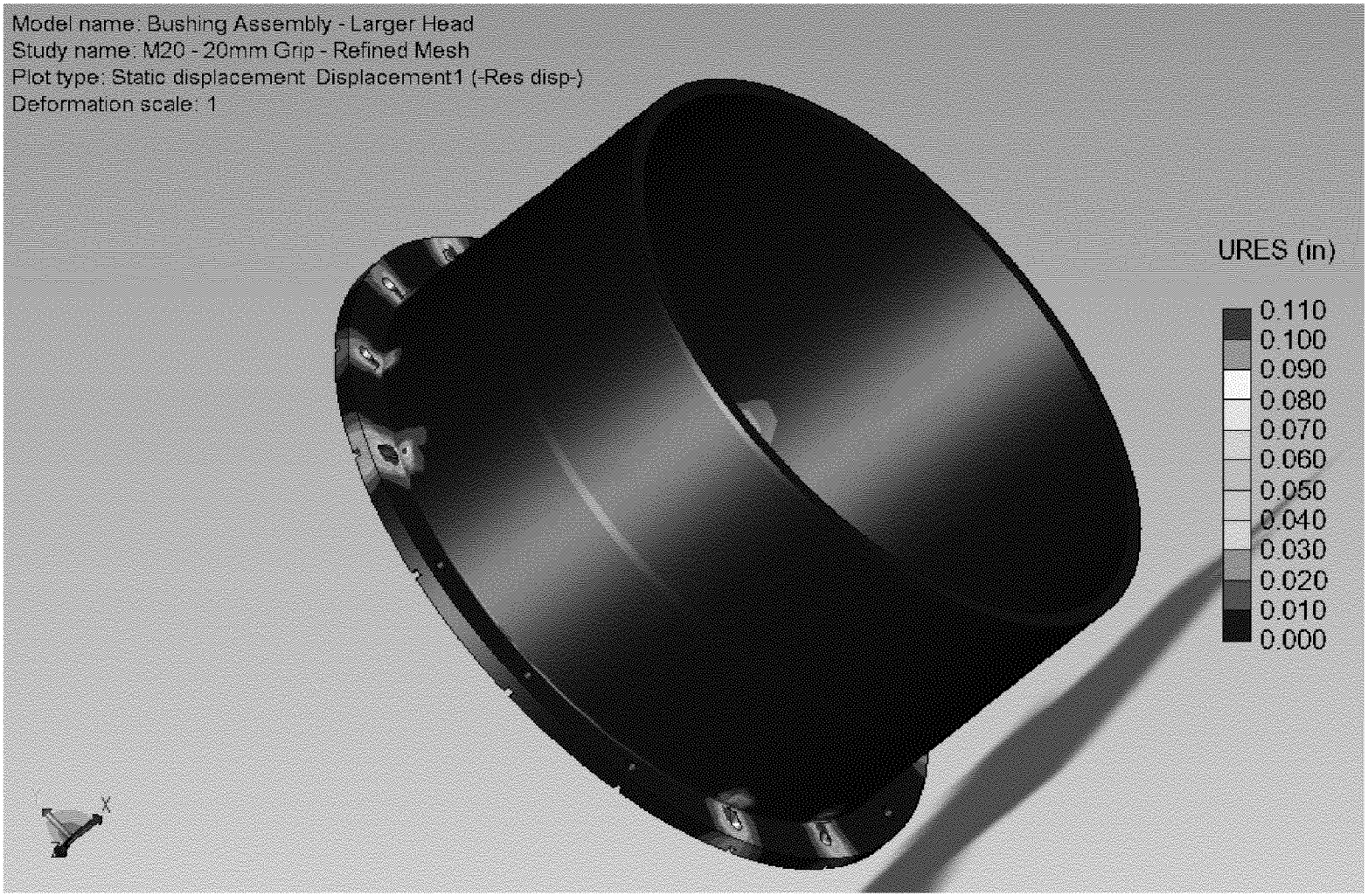
FIG. 6 illustrates modeled deformation results of a first contemplated modification to the prior art bronze bushing design.
Figure 7:
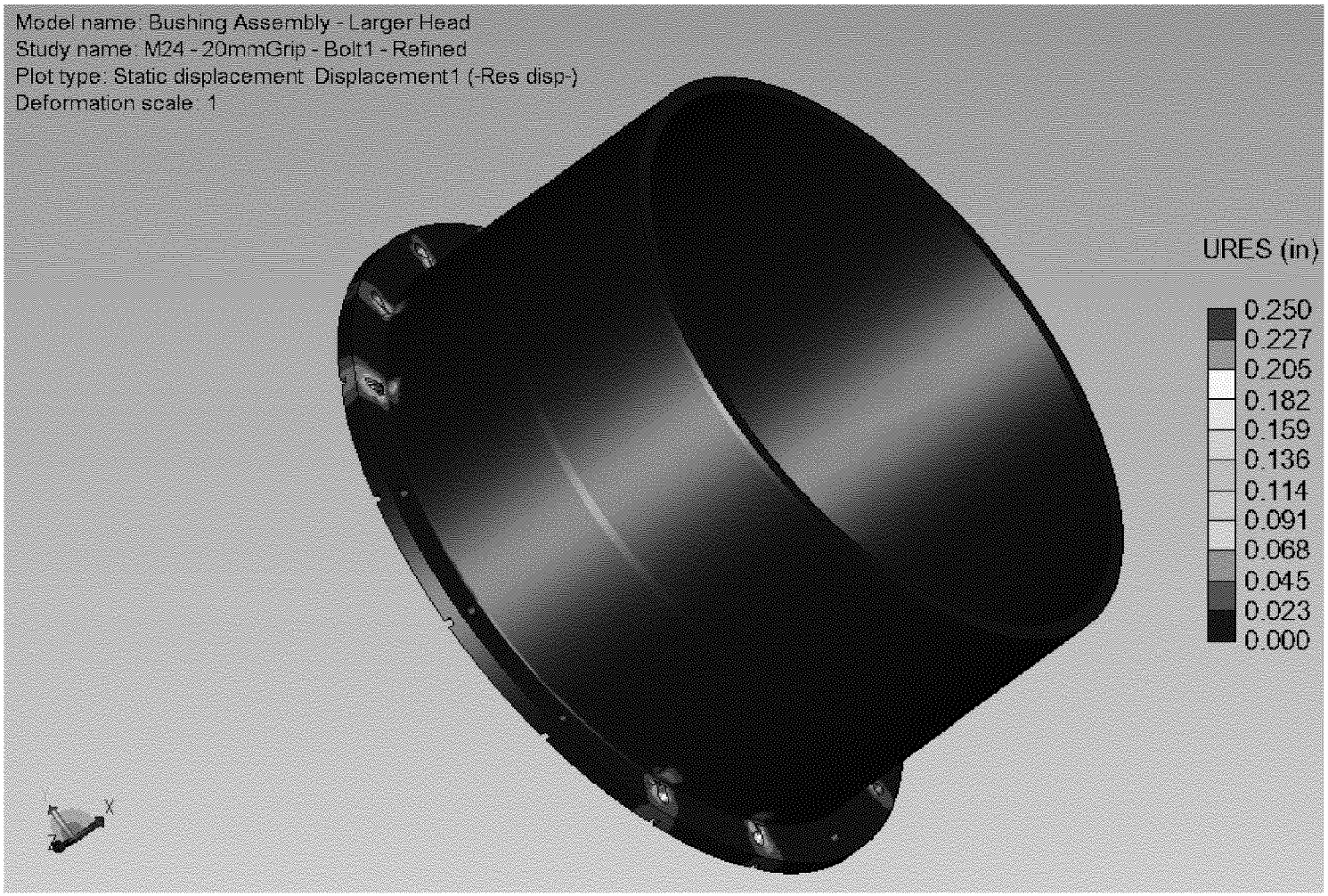
FIG. 7 illustrates modeled deformation results of a second contemplated modification to the prior art bronze bushing design.
Figure 8:
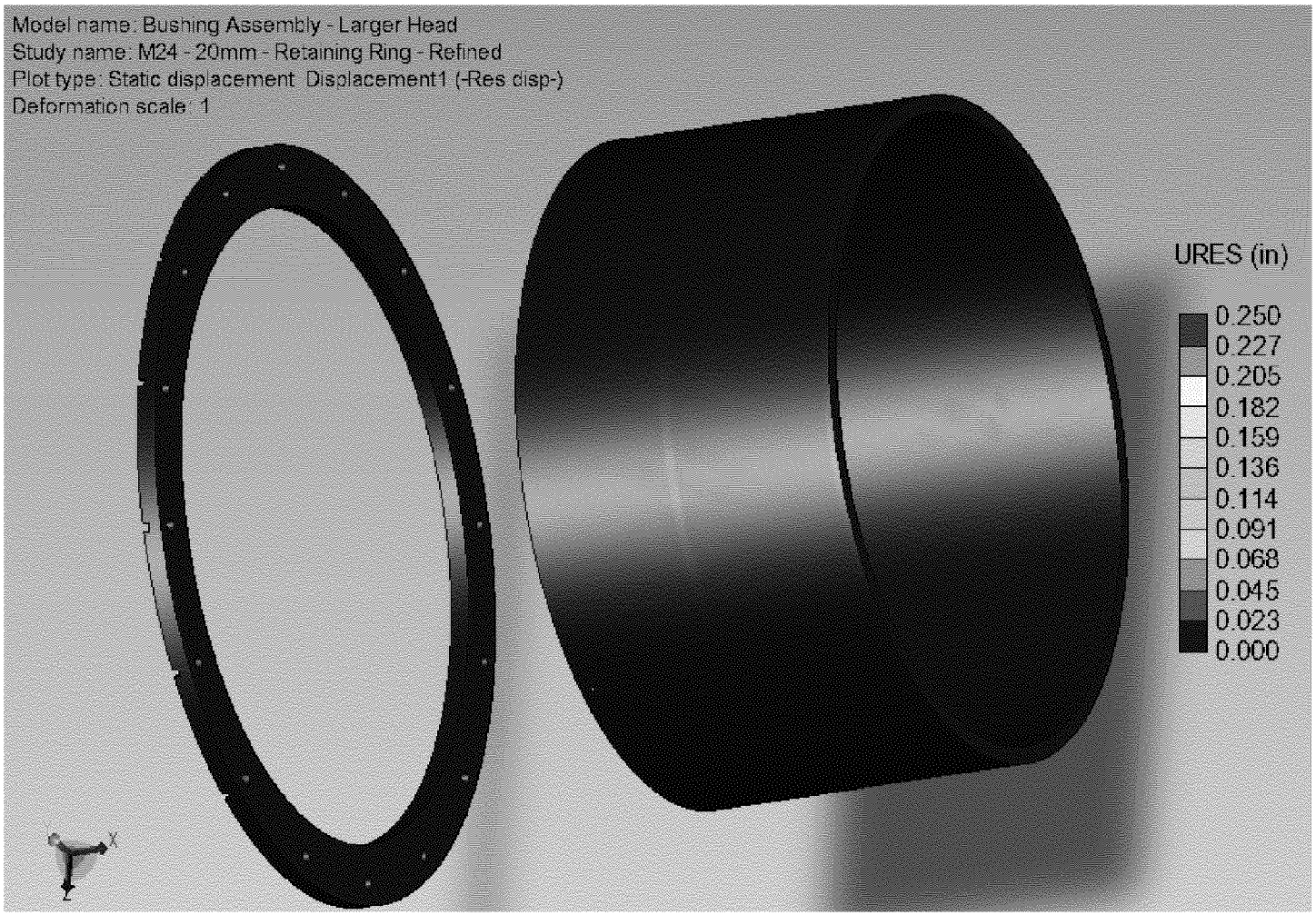
FIG. 8 illustrates modeled deformation results of a present preferred retaining member and bushing arrangement.

Deformations resulting from the above discussed loads for each configuration are shown in FIGS. 5, 6, 7 and 8. FIG. 5 illustrates the modeled deformation experienced by the prior art configuration. FIG. 6 illustrates the modeled deformation experienced by the first contemplated improvement, which included the twenty millimeter thick flange. FIG. 7 illustrates the modeled deformation experienced by the second contemplated improvement, which included the twenty millimeter thick flange and the twenty-four millimeter diameter bolts. FIG. 8 illustrates the modeled deformation experienced by an embodiment of the retaining member design discussed above with reference to FIGS. 1-3.

The conducted modeling showed that the amount of flange deformation can be reduced through the increased flange thickness as well as the increased diameter of the flange bolts. Surprisingly, it was determined that there is as much as a 75% reduction in deformation and bolt loads by the use of the decoupled retaining member discussed above. As may be appreciated from FIG. 8, this is particularly true in the local regions surrounding the bolt holes in the retaining member relative to the flange holes of the other designs shown in FIGS. 5-7. The 75% reduction is a substantial improvement over the prior art bushing arrangement and is a substantial improvement over other obvious first and second contemplated improvements to the prior art bushing arrangements (e.g., thickening the flange or flange bolts used in the prior art design).

The conducted modeling also showed the general stress states experienced by the prior art design, first contemplated improvement, second contemplated improvement and an embodiment of the retaining member assembly discussed above. The determined stress values should be considered "relative" since the actual loads utilized were extremely conservative and the exact loads are not specifically known due to substantial differences in application and environment. However, because the software is linear in nature, the percentage change in maximum deformations and stresses are of interest, as opposed to the absolute values.

Figure 9:
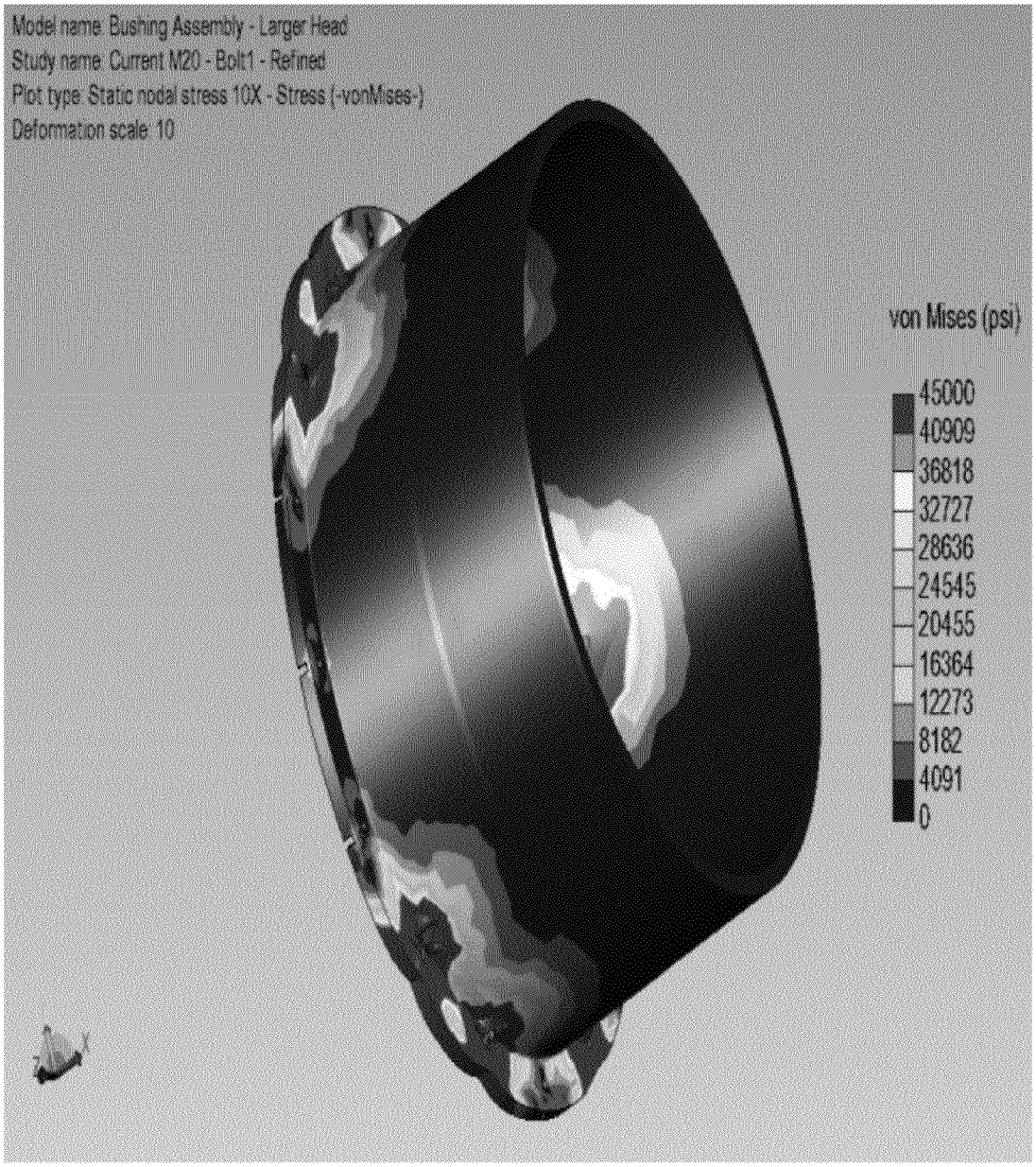
FIG. 9 illustrates modeled static nodal stress results of a prior art bronze bushing design.
Figure 10:
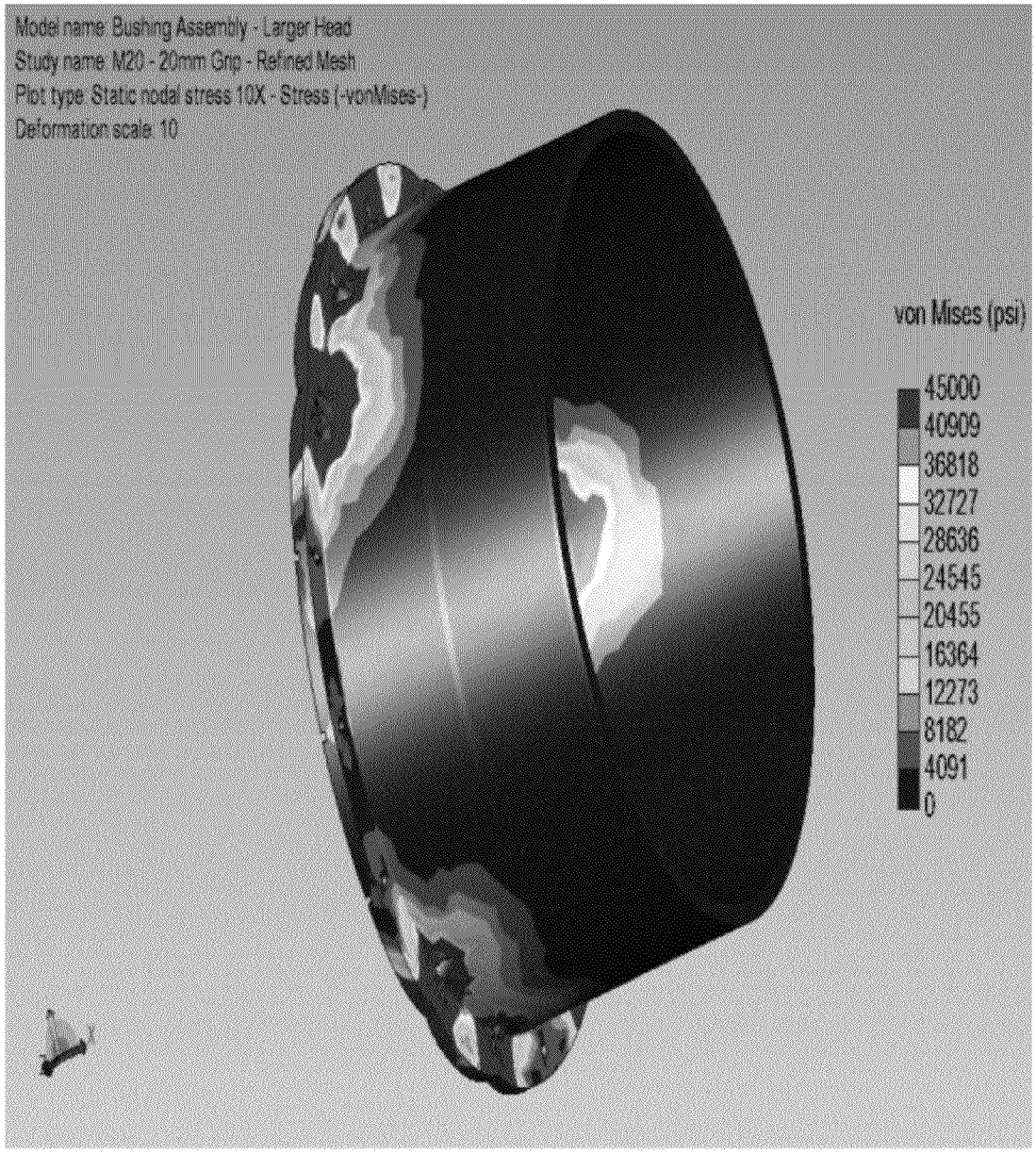
FIG. 10 illustrates modeled static nodal stress results of a first contemplated modification to the prior art bronze bushing design.
Figure 11:
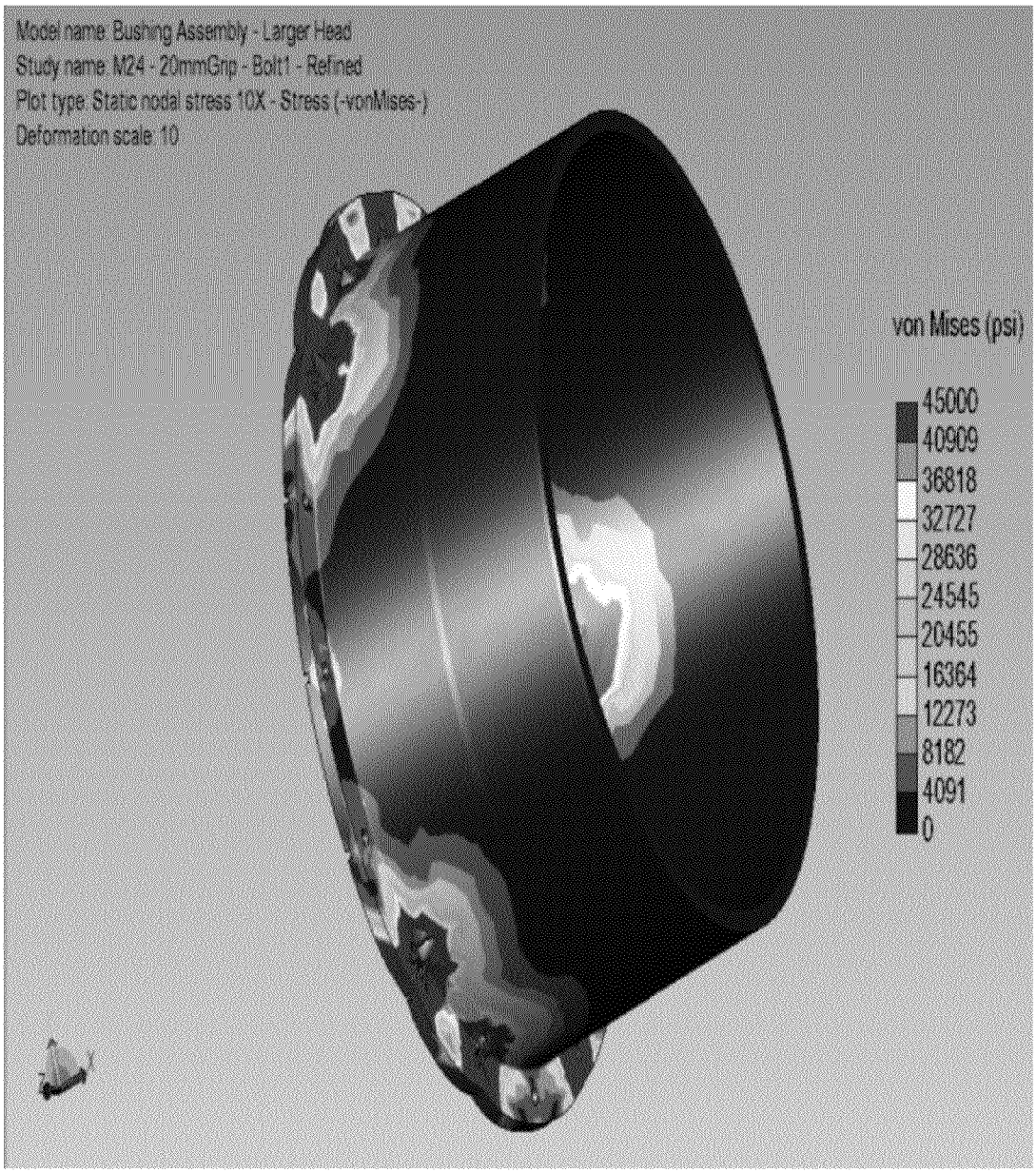
FIG. 11 illustrates modeled static nodal stress results of a second contemplated modification to the prior art bronze bushing design.
Figure 12:
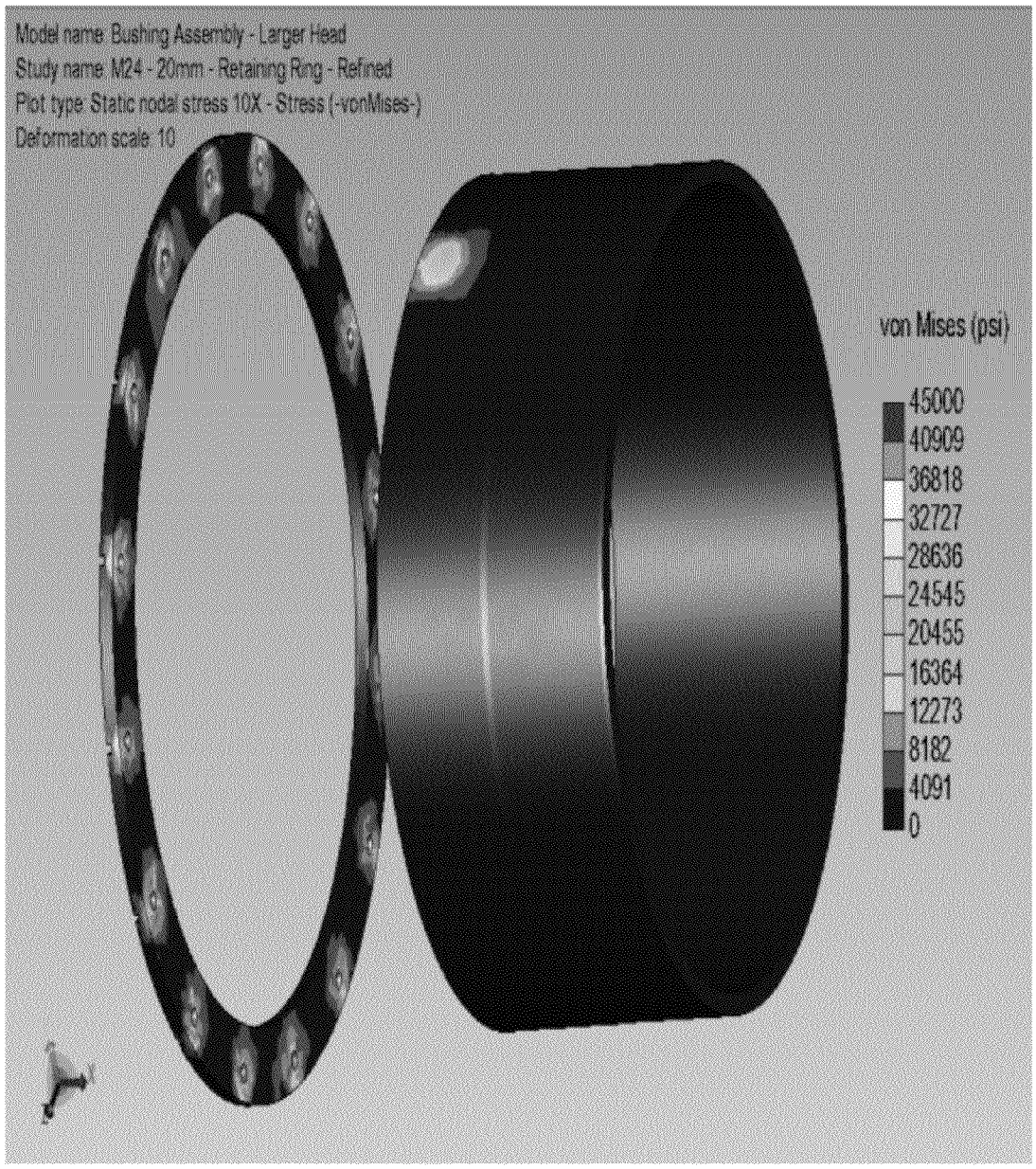
FIG. 12 illustrates modeled static nodal stress results of a present preferred retaining member and bushing arrangement that may be utilized in embodiments of the crusher device.

The modeled stress states for each design are shown in FIGS. 9-12. FIG. 9 illustrates the modeled stress experienced by the prior art configuration. FIG. 10 illustrates the modeled stress experienced by the first contemplated improvement, which included the twenty millimeter thick flange. FIG. 11 illustrates the modeled stress experienced by the second contemplated improvement, which included the twenty millimeter thick flange and the twenty-four millimeter diameter bolts. FIG. 12 illustrates the modeled stress experienced by the embodiment of the retaining member design discussed above with reference to FIGS. 1-3.

The stress levels in and around the bolt holes and retaining member of the decoupled retaining member design were found to provide between 70% and 85% less shear and bending stress than the different integral flange improvements and prior art design, as may be appreciated from the modeling results shown in FIGS. 9-12.

The modeling also evaluated the bolt loads. The modeling determined that the bolt elasticity under load, as well as the necessary constraining stiffness on the grip elements of the bolts. The below table 1 shows the relative differences in maximum bolt loads/stresses, between the prior art design and first and second contemplated improvements, which all utilize an integral flange design and an embodiment of the decoupled retaining member design discussed above.

TABLE 1

Relative loads/stresses modeling results

| Model | Shear stress | Axial Stress | Bending Stress (prying load) |
|---|---|---|---|
| Prior art design | 1.00 | 1.00 | 1.00 |
| First contemplated improvement (thicker flange) | 0.65 | 0.99 | 0.59 |
| Second contemplated improvement (thicker flange and thicker bolts) | 0.46 | 0.95 | 0.50 |
| Decoupled retaining member design | 0.07 | 1.03 | 0.08 |

As may be appreciated from the results of the modeling shown in Table 1, the decoupled retaining member design showed a substantial reduction in bolt loads relative to the prior art design and other contemplated improved designs. In particular, the decoupled retaining member design showed a substantial reduction in bolt loads, which included stresses due to bolt prying moments, or bending stress.

From the conducted modeling, it is clear that the obvious improved designs that utilized thicker flanges or thicker bolts could provide a slight improvement for reducing deformation, stress, and bolt loads experienced during operation of a cone crusher. However, the decoupled retaining member design provides a substantial reduction in deformation, stress and bolt loads. Indeed, the modeling shows that the decoupled retaining member design provides a surprisingly large improvement relative to the other improved designs that were contemplated.

Moreover, the decoupled retaining member design permits the design to be incorporated into crusher devices without requiring extensive redesigning of other cone crusher components. Such a design can therefore help reduce costs associated with fabricating cone crushers using the new design discussed above and shown in FIGS. 1-3.

The conducted modeling shows that there are significant improvements provided by embodiments of the cone crusher that include a retaining member that is decoupled from a bushing. As the modeling results show, such decoupling provides a cone crusher that may experience significantly more stress and strain from operations than other designs that utilize a bushing with an integral flange.

Figure 14:
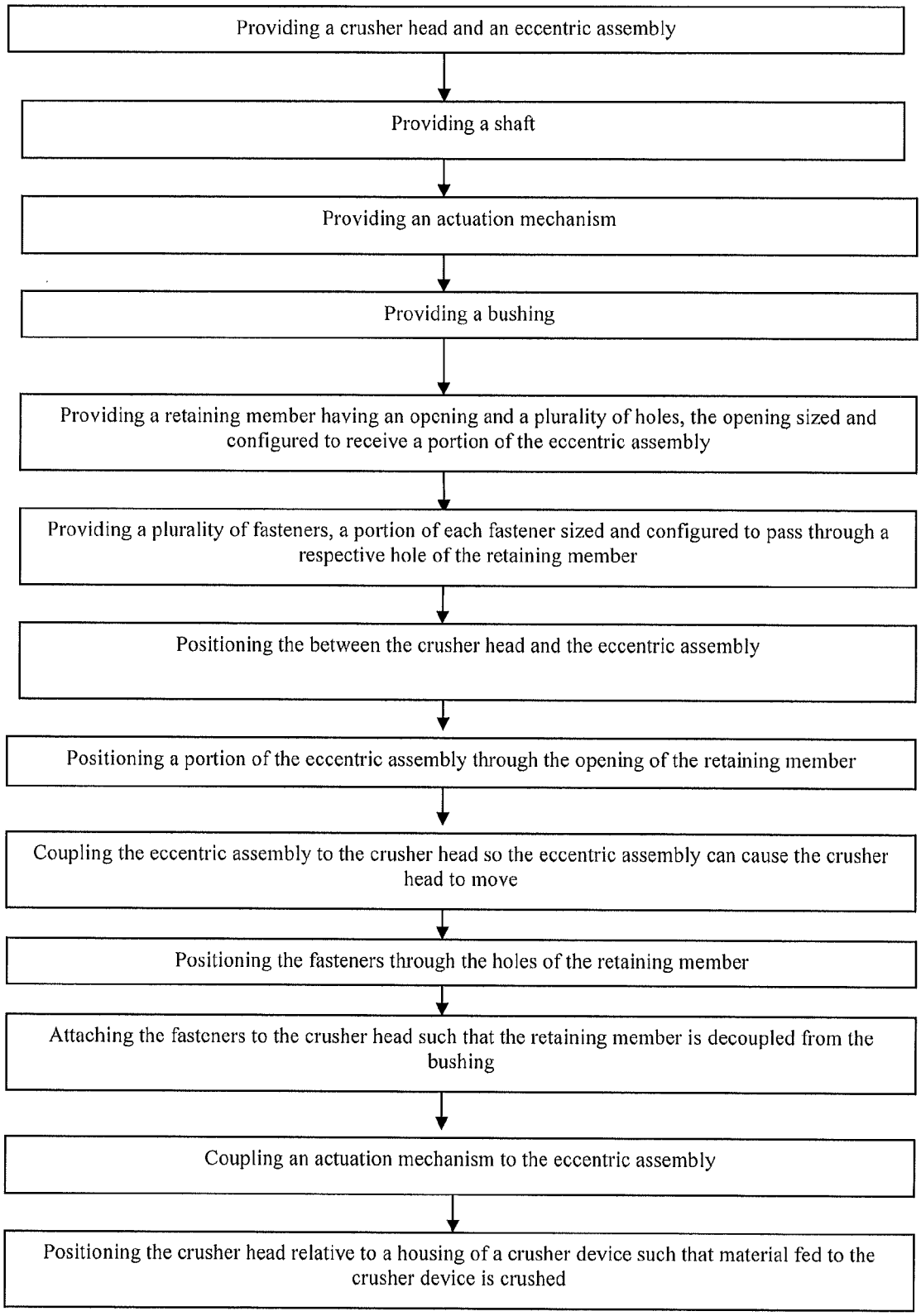
FIG. 14 is a flow chart illustrating a first present preferred embodiment of a method for making a crusher device. Preferably, the crusher device is a cone crusher or other gyratory crusher.

A method of providing a crusher device is also provided, as may be appreciated from FIG. 14. Preferably, embodiments of the method are performed to retrofit existing cone crusher or other gyrator crushers to include embodiments of the decoupled retaining member design discussed above to form an embodiment of the crusher device. An embodiment of our method may include providing a crusher head, a bushing, an eccentric assembly, fasteners, and a retaining member. The retaining member has an opening sized to receive a portion of the eccentric and a plurality of holes sized to receive fasteners. The eccentric is positioned through the opening of the retaining member and the bushing is positioned between the crusher head and the eccentric assembly. The fasteners are positioned through the holes of the retaining member. The fasteners are also attached to the crusher head such that the retaining member is decoupled from the bushing.

The bushing may be attached between the crusher head and the eccentric assembly to link the eccentric to the crusher head. Preferably, the bushing is positioned such that a portion of the bushing is within the opening of the retaining member and is attached to the crusher head such that the bushing is decoupled from the retaining member.

It should be understood that a customer may be provided with a gyratory crusher such as a cone crusher in one sale. Thereafter, a customer may be told of a method of retrofitting that cone crusher or other gyratory crusher to form a cone crusher that includes a decoupled retaining member. Such a retrofitted cone crusher or other gyratory crusher may be similar to the embodiment shown in FIGS. 1 and 2. The retaining member may be provided by a supplier or may be purchased from the vendor that previously sold the customer the gyratory crusher. It is contemplated that the vendor or the customer may perform the retrofitting.

Variations of the present preferred embodiments of the crusher device and method of making the crusher device discussed above may be made. For instance, though a thickness of a retaining member is preferred to be nineteen millimeters or 0.75 inches, other thicknesses may be used. Similarly, different sized bolts or a different number of bolts may be used in conjunction with the retaining member. The retaining member, bushing, or other elements may be composed of different metals or other materials or may be sized or shaped differently to meet certain design criteria specified by a customer or a particular design objective. Of course, other variations to the above discussed cone crusher or other crushing devices may be made to meet different crushing design criteria or other design criteria.

While certain present preferred embodiments of crushing devices and methods of making and using the same have been shown and described above, it is to be distinctly understood that the invention is not limited thereto but may be otherwise variously embodied and practiced within the scope of the following claims.

What is claimed is:

1. A gyratory crusher comprising:

a crusher head;

an eccentric assembly attached to the crusher head;

a shaft positioned to support at least one of the crusher head and the eccentric assembly;

an actuation mechanism coupled to the eccentric assembly to move the eccentric assembly;

a bushing positioned between the crusher head and the eccentric assembly;

a retaining member, the retaining member having an opening and a plurality of holes, the retaining member positioned adjacent to the eccentric assembly such that a portion of the eccentric assembly is within the opening;

a plurality of fasteners, each fastener extending through a respective hole in the retaining member to the crusher head; and the retaining member being positioned adjacent to the eccentric assembly and the crusher head such that the retaining member is decoupled from the bushing.

2. The gyratory crusher of claim 1 wherein the actuation mechanism is comprised of a rotatable countershaft attached to a drive assembly, the drive assembly configured to be rotated by a moveable belt.

3. The gyratory crusher of claim 1 wherein a portion of the bushing is attached between the crusher head and the eccentric assembly to attach the eccentric assembly to the crusher head, a portion of the bushing being positioned above the opening of the retaining member.

4. The gyratory crusher of claim 3 wherein the retaining member is a ring composed of steel or stainless steel and the bushing is composed of bronze.

5. The gyratory crusher of claim 1 wherein the eccentric assembly is comprised of an eccentric attached to an eccentric bushing and a gear, the gear being attached to the actuation mechanism and the eccentric bushing being positioned between the eccentric and the shaft, and wherein the gyratory crusher is a cone crusher.

6. The gyratory crusher of claim 1 wherein the actuation mechanism is configured to transfer power or kinetic energy from a drive mechanism to the eccentric assembly to move the eccentric assembly.

7. The gyratory crusher of claim 1 wherein the retaining member has a generally cylindrical, generally circular, generally rectangular or generally polygonal shape.

8. The gyratory crusher of claim 1 wherein the fasteners are bolts or screws.

9. The gyratory crusher of claim 1 wherein each fastener has a first end and a second end opposite the first end, the first end having a head and the second end having threads, and wherein the retaining member has a first surface and a second surface opposite the first surface, the first surface facing toward the crusher head, each fastener extending through a respective hole such that a portion of the head of each fastener engages or applies force to a portion of the second surface of the retaining member and the second end of each fastener engages a portion of the crusher head.

10. The gyratory crusher of claim 9 further comprising a plurality of washers, each washer between the head of a respective fastener and the second surface of the retaining member.

11. A method of making or retrofitting a crusher device configured to crush at least one of rock, ore, minerals and stone comprising:

positioning an eccentric assembly through an opening of a retaining member;

positioning a bushing between the eccentric assembly and a crusher head;

coupling the eccentric assembly to the crusher head;

positioning fasteners through holes in the retaining member;

attaching the fasteners to the crusher head;

coupling an actuation mechanism to the eccentric assembly; and the fasteners attached to the crusher head and eccentric assembly coupled to the crusher head such that the retaining member is decoupled from the bushing.

12. The method of claim 11 further comprising attaching the bushing to the crusher head.

13. The method of claim 12 further comprising positioning the bushing between the crusher head and the retaining member such that at least a portion of the bushing is above the retaining member.

14. The method of claim 13 wherein the retaining member is a ring or a plate.

15. The method of claim 11 wherein the actuation mechanism is comprised of a rotatable countershaft positioned between the eccentric assembly and a drive assembly.

16. The method of claim 11 wherein the eccentric assembly is comprised of an eccentric attached to an eccentric bushing, the eccentric bushing being positioned between the eccentric and a shaft positioned adjacent to the crusher head and the eccentric.

17. The method of claim 11 wherein each fastener has a first end and a second end opposite the first end, the first end having a head and the second end having threads, and the retaining member has a first surface and a second surface opposite the first surface, the method further comprising:

positioning the retaining member relative to the eccentric assembly and crusher head such that the first surface faces toward the crusher head; extending each fastener through a respective hole in the retaining member such that a portion of the head of each fastener engages or applies force to a portion of the second surface of the retaining member and the second end of the retaining member engages a portion of the crusher head.

18. The method of claim 11 further comprising positioning a shaft adjacent to the eccentric assembly and the crusher head to provide support to at least one of the eccentric assembly and the crusher head.

* * * * *